US008216000B2

(12) United States Patent
Su et al.

(10) Patent No.: US 8,216,000 B2
(45) Date of Patent: Jul. 10, 2012

(54) AUDIO JACK CONNECTOR

(75) Inventors: Yu-Hung Su, Tu-Cheng (TW); Yao-Ting Wang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 138 days.

(21) Appl. No.: 12/871,815

(22) Filed: Aug. 30, 2010

(65) Prior Publication Data

US 2012/0052705 A1 Mar. 1, 2012

(51) Int. Cl.
*H01R 24/04* (2006.01)

(52) U.S. Cl. ..... 439/668; 439/188; 200/51.1

(58) Field of Classification Search ..... 439/668, 439/188, 669; 200/51 R, 51.09, 51.11, 51.1
See application file for complete search history.

(56) References Cited

U.S. PATENT DOCUMENTS

| | | | | |
|---|---|---|---|---|
| 6,077,126 | A * | 6/2000 | Peng | 439/668 |
| 6,368,156 | B1 * | 4/2002 | Lin | 439/668 |
| 2007/0232150 | A1 * | 10/2007 | Lee | 439/668 |
| 2008/0318457 | A1 * | 12/2008 | Li et al. | 439/188 |
| 2009/0011629 | A1 * | 1/2009 | Wang et al. | 439/188 |

* cited by examiner

*Primary Examiner* — Gary F. Paumen
(74) *Attorney, Agent, or Firm* — Cheng-Ju Chiang

(57) ABSTRACT

An audio jack connector adapted for receiving a plug has a base having a socket. The base has a first terminal groove and a second terminal groove opened at one side of the socket. The second terminal groove is located between the socket and the first terminal groove and connects with the socket by means of a first connecting passage. A stationary switch terminal has a first fixing slice fastened in the second terminal groove, a first contacting end projected in the first connecting passage and an opening opened in first fixing slice. A resilient switch terminal has a second fixing slice fastened in the first terminal groove, a second contacting end projected into the socket through the first connecting passage and elastically received in the opening when the second contacting end is biased by the plug to be disconnected from the first contacting end.

5 Claims, 6 Drawing Sheets

AUDIO JACK CONNECTOR

BACKGROUND OF THE INVENTION

1. Field of the Invention

The present invention relates to an audio jack connector, and particularly to an audio jack connector having a set of switch terminals.

2. The Related Art

Audio jack connectors are widely used in kinds of electronic equipments, such as MP3/MP4, mobile phones, computers and other equipments for transmitting sound signals. A conventional audio jack connector includes an insulating housing, a signal terminal group and a switch terminal group including a stationary switch terminal and a resilient switch terminal. The insulating housing has a socket and a plurality of grooves communicating with the socket. The signal terminal group and the switch terminal group are mounted in the grooves respectively. The stationary switch terminal has a first fixing slice, and a first connecting arm extended from the first fixing slice. The resilient switch terminal has a second fixing slice, and an arch-shaped second connecting arm extended from the second fixing slice and projected into the socket. A free end of the first connecting arm electrically abuts against the second connecting arm. When a plug is inserted into the socket of the audio jack connector, the plug biases the second connecting arm to make the second connecting arm disconnected with the first connecting arm of the stationary switch terminal. However, under the condition of the second connecting arm being excessively biased by the plug, the second connecting arm of the resilient switch terminal may be pressed against the second fixing slice or the first fixing slice to result in an over-deformation thereof. As a result, the second connecting arm can not return automatically to connect the stationary switch terminal again, after the plug is withdrawn from the socket of the audio jack connector. Furthermore, the second connecting arm may be set free by the plug to contact with the first connecting arm in a period of the plug being in the socket, when the plug is swayed towards a side opposite to the second connecting arm. Those cause the switch terminal group to lose corresponding capabilities thereof.

SUMMARY OF THE INVENTION

Accordingly, an object of the present invention is to provide an audio jack connector adapted for receiving a plug. The audio jack connector includes an insulating housing. The insulating housing has a socket extending along the insertion direction of the plug for receiving the plug therein, a first terminal groove and a second terminal groove being opened at one side of the socket and parallel to the insertion direction of the plug. The second terminal groove is located between the socket and the first terminal groove and connects with the socket by means of a first connecting passage. A plurality of signal terminals is disposed in the insulating housing to electrically connect with the plug. A stationary switch terminal has a first fixing slice fastened in the second terminal groove, a first connecting arm of substantially lying-L shape extending from an end edge of the first fixing slice with a free arm being substantially parallel to the first fixing slice. A distal end of the free arm of the first connecting arm is provided with a first contacting end projecting in the first connecting passage. An opening is opened in the second fixing slice facing to the first contacting end. A resilient switch terminal has a second fixing slice fastened in the first terminal groove. One end edge of the second fixing slice bends and then extends to form a second connecting arm apart facing the second fixing slice and received in the first connecting passage. A free end of the second connecting arm arches oppositely to the second fixing slice to form a second contacting end and projects into the socket through the first connecting passage. The second contacting end is elastically received in the opening when the second contacting end is biased by the plug to be disconnected from the first contacting end of the stationary switch terminal.

As described above, since the stationary switch terminal has the opening opened in the first fixing slice thereof to receive the second contacting end. So when the plug excessively biases the second contacting end of the resilient switch terminal, such structure can avoid the deformation of the second contacting arm and further prolong the use life of the audio jack connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
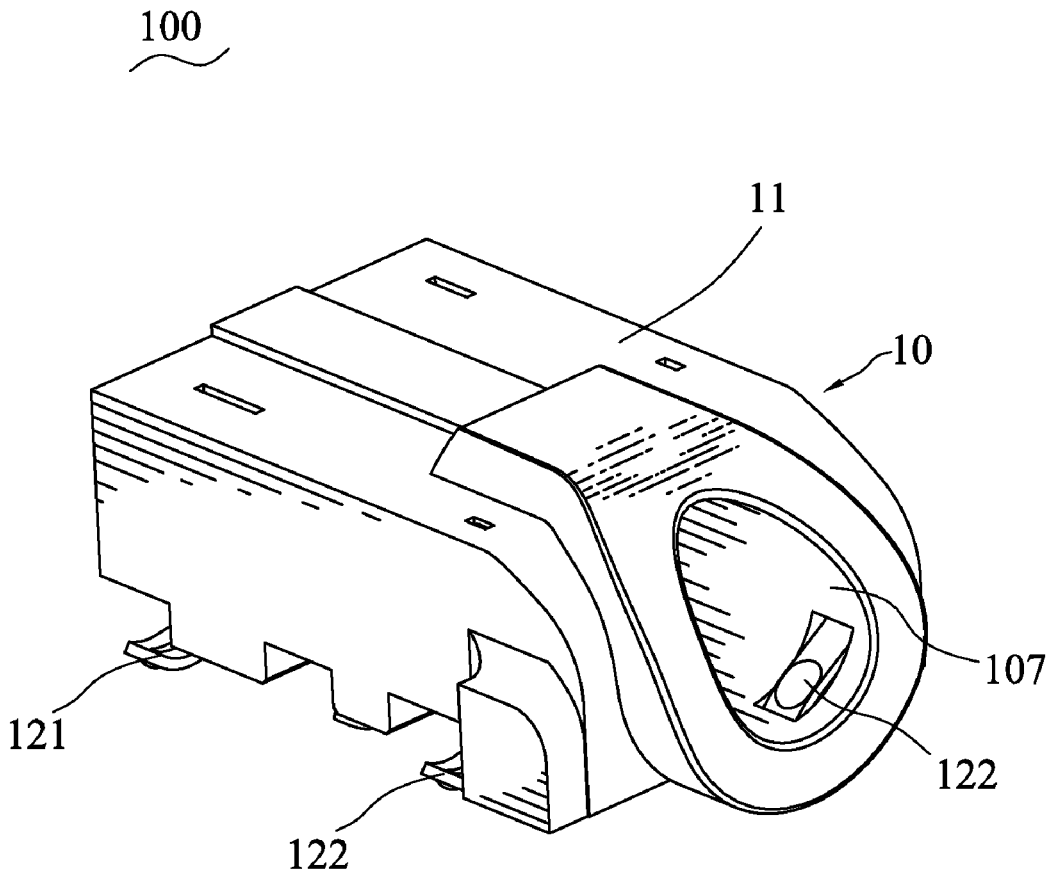
FIG. 1 is an assembled, perspective view of an audio jack connector of an embodiment in accordance with the present invention.
Figure 2:
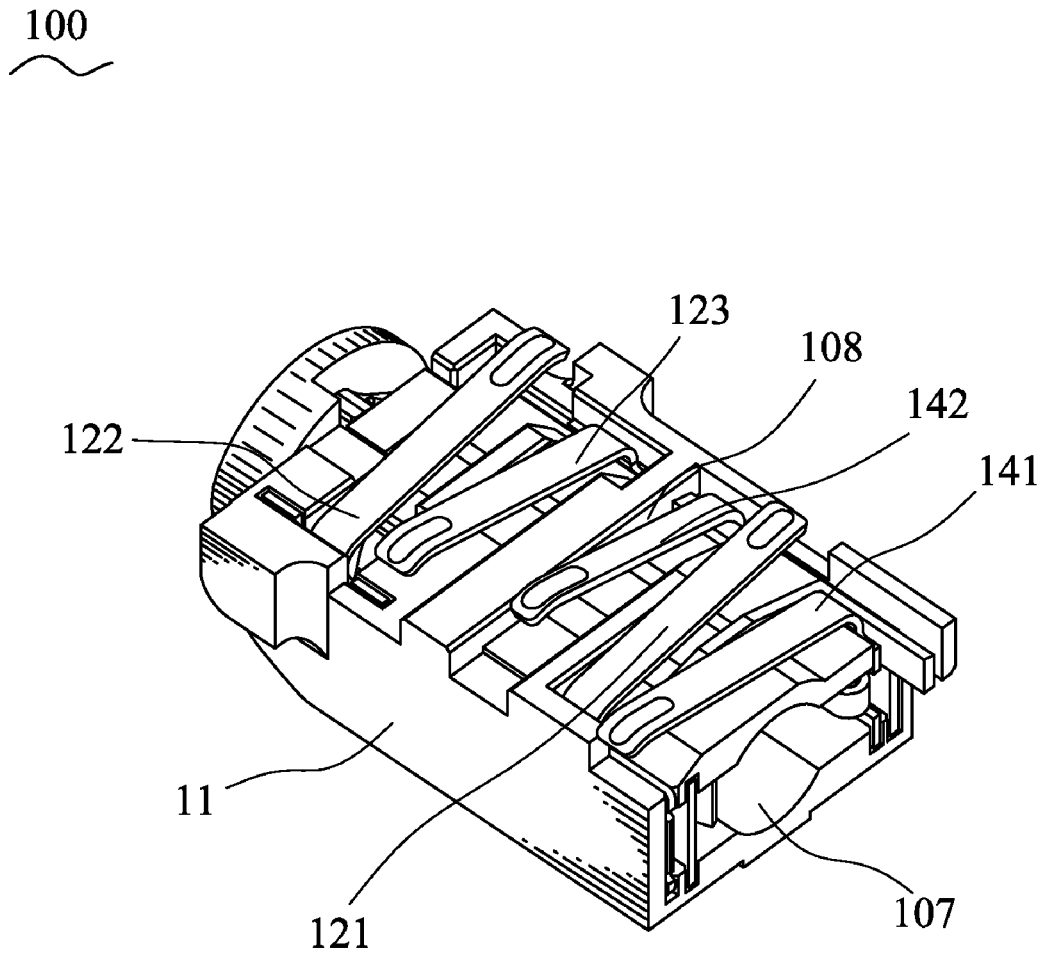
FIG. 2 is an assembled, perspective view of the audio jack connector of FIG. 1 viewed from another angle.
Figure 3:
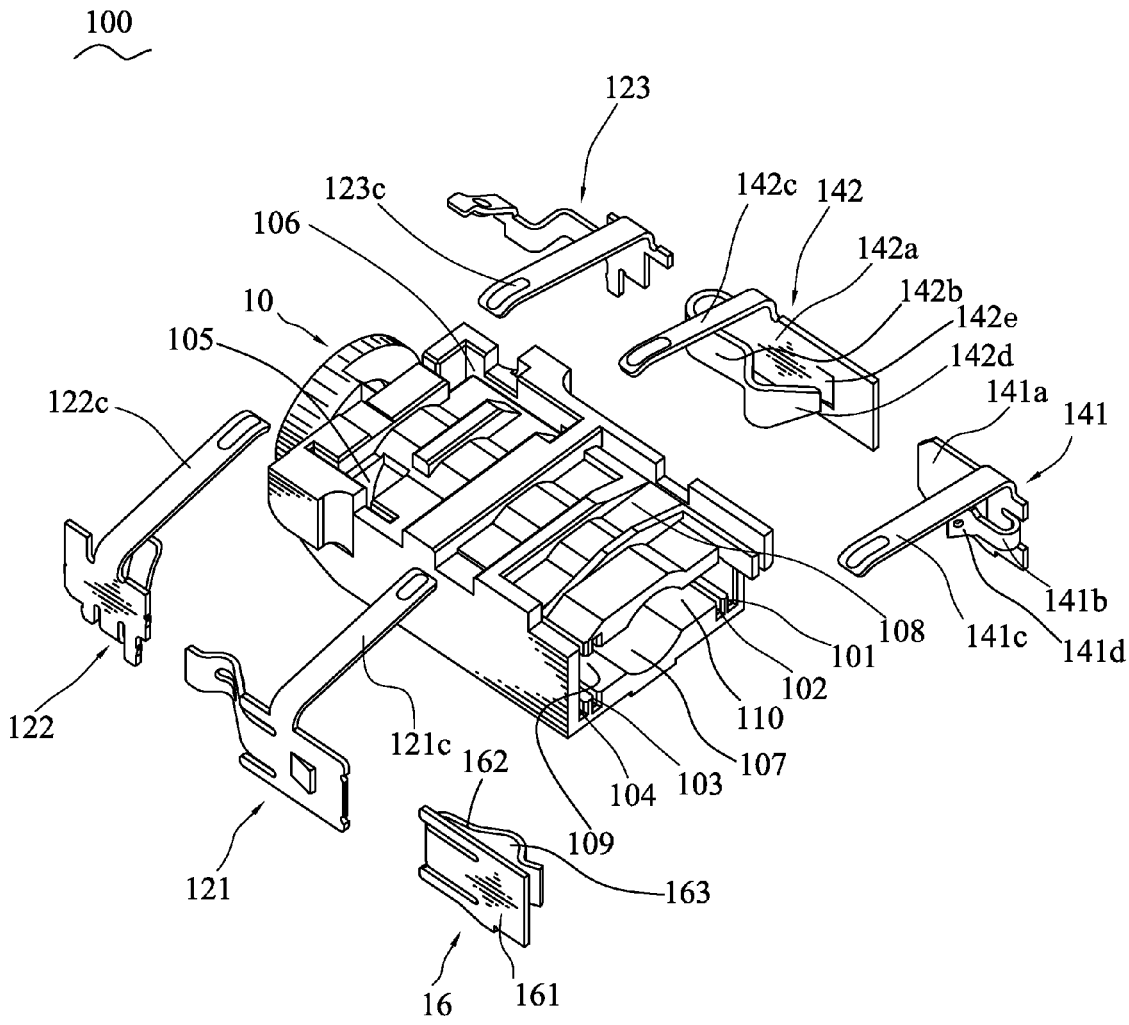
FIG. 3 is an exploded, perspective view of the audio jack connector shown in FIG. 1.

Referring to the drawings in greater detail, and first to FIGS. 1-3, the embodiment of the invention is embodied in an audio jack connector 100. The audio jack connector 100 includes an insulating housing 10, a signal terminal group including a first signal terminal 121, a second signal terminal 122 and a third signal terminal 123, a switch terminal group including a stationary switch terminal 141 and a resilient switch terminal 142, and a locking element 16.

Referring to FIGS. 2-3, the insulating housing 10 has a substantially rectangular base 11. The base 11 has a socket 107 extending along a lengthways direction thereof and passing through substantial middles of two opposite ends thereof for accommodating a plug 200 (shown in FIG. 5). Two opposite sides of a front surface of the base 11 define a first terminal groove 101 for receiving the resilient switch terminal 142, a second terminal groove 102 for receiving the stationary switch terminal 141, a third terminal groove 103 for receiving the locking element 16, and a fourth terminal groove 104 for receiving the first signal terminal 121. The first terminal groove 101 and the second terminal groove 102 are both disposed at one side of the socket 107 and each extends parallel to the extending direction of the socket 107, wherein the second terminal groove 102 is located between the socket 107 and the first terminal groove 101 and has a substantial middle connected with the socket 107 by means of a first connecting passage 110 extending longitudinally to penetrate through the front surface of the base 11. The third terminal groove 103 and the fourth terminal groove 104 are both disposed at the other side of the socket 107 and each extends parallel to the extending direction of the socket 107, wherein the third terminal groove 103 is closer to the socket 107 than the fourth terminal groove 104, substantial middles of the third and fourth terminal grooves 103, 104 are connected with the socket 107 by means of a second connecting passage 109 extending longitudinally to penetrate through the front surface of the base 11. A rear portion of a top surface of the base 11 defines a fifth terminal groove 105 for receiving the second signal terminal 122 and a sixth terminal groove 106 for receiving the third signal terminal 123, which are located at two opposite sides of the socket 107 and connected with the socket 107. The top surface of the base 11 further defines a plurality of indentation areas 108 paralleling with each other and respectively connecting with the terminal grooves 101, 102, 104, 105, 106 except the third terminal groove 103.

Referring to FIG. 2 and FIG. 3 again, the first signal terminal 121, the second signal terminal 122 and the third signal terminal 123 respectively have a first resilient portion 121*c*, a second resilient portion 122*c*, and a third resilient portion 123*c* received in the corresponding indentation areas 108 of the insulating housing 10 respectively.

Figure 4:
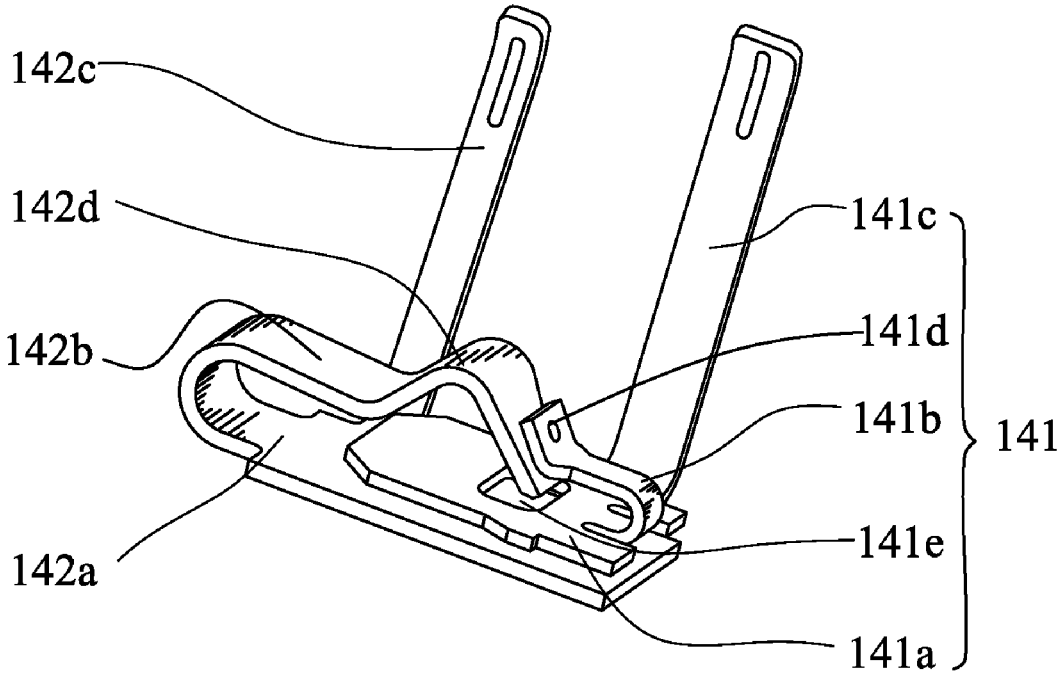
FIG. 4 shows a relationship between a resilient switch terminal and a stationary switch terminal of the audio jack connector of FIG. 1.
Figure 6:
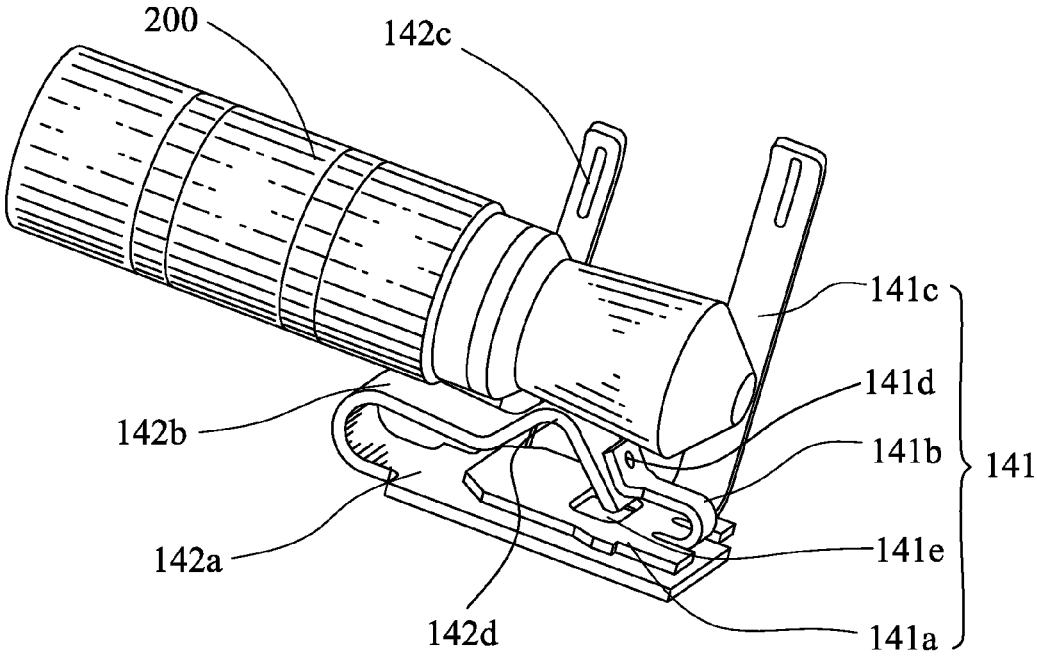
FIG. 6 shows a relationship between the plug and a switch terminal group of FIG. 5.

With reference to FIG. 3, FIG. 4 and FIG. 6, the stationary switch terminal 141 has a substantially rectangular first fixing slice 141*a*, a first connecting arm 141*b* extended from a middle portion of a front edge of the first fixing slice 141*a*, and a strip-shaped first resilient arm 141*c* extended towards one side and slanted upwardly from a top edge of the first fixing slice 141*a*. In this embodiment, the first resilient arm 141*c* has an arch-like distal end. The first connecting arm 141*b* bends towards a same side as the first resilient arm 141*c* with respect to the first fixing slice 141*a* and is apart facing the first fixing slice 141*a*. A distal end of the first connecting arm 141*b* is obliquely bent oppositely to the first fixing slice 141*a* to form a first contacting end 141*d*. An opening 141*e* is opened in the first fixing slice 141*a* substantially facing to the first contacting end 141*d*.

Referring to FIG. 3, FIG. 4 and FIG. 6 again, the resilient switch terminal 142 has a substantially rectangular second fixing slice 142*a*, a second connecting arm 142*b* bent and then extended forward from a middle portion of a rear edge of the second fixing slice 142*a*, and a strip-shaped second resilient arm 142*c* extended towards one side and slanted upwardly from a top edge of the second fixing slice 142*a*. In this embodiment, the second resilient arm 142*c* has an arch-like distal end. The second connecting arm 142*b* apart faces the second fixing slice 142*a* and has a second contacting end 142*d* arched oppositely to the second fixing slice 142*a*. The second contacting end 142*d* can be received in the opening 141*e* of the stationary switch terminal 141 under being biased by the plug 200. The second fixing slice 142*a* is punched away from the second contacting end 142*d* to form a buckling portion 142*e*.

Figure 5:
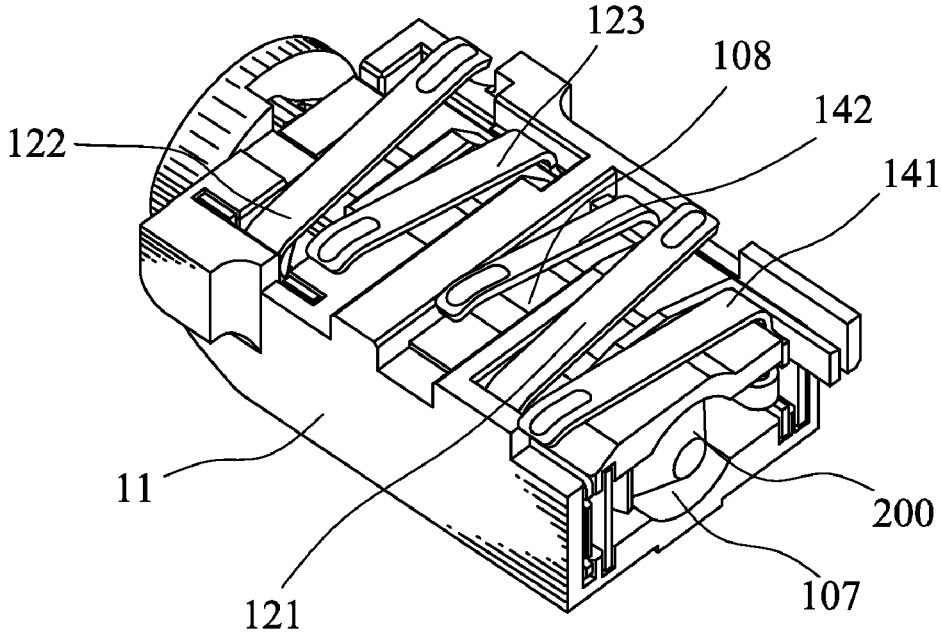
FIG. 5 is a perspective view showing that a plug is inserted in the audio jack connector of FIG. 2.

With reference to FIG. 3, the locking element 16 has a holding slice 161, and a flexible slice 162 bent and then extended forwards from a middle portion of a rear edge of the holding slice 161. A propping convex 163 is arched oppositely to the holding slice 161 from a free end of the flexible slice 162. When the plug 200 shown in FIGS. 5 and 6 is inserted into the socket 107 of the insulating housing 10, the plug 200 is gripped between the propping convex 163 of the locking element 16 and the second contacting end 142*d* of the resilient switch terminal 142. Therefore, the plug 200 is kept in the audio jack connector 100 more firmly.

Please refer to FIGS. 1-5. In assembly, the first fixing slice 141*a* of the stationary switch terminal 141 is mounted in the second terminal groove 102, with the first contacting end 141*d* projecting in the first connecting passage 110. The second fixing slice 142*a* of the resilient switch terminal 142 is secured in the first terminal groove 101 by means of the buckling portion 142*e* abutting against an inside of the first terminal groove 101, and apart faces the first fixing slice 141*a*, with the second contacting end 142*d* projecting into the socket 107 through the first connecting passage 110, and the first contacting end 141*d* contacting with the second contacting end 142*d*. The holding slice 161 of the locking element 16 is held in the third terminal groove 103, with the propping convex 163 projecting into the socket 107 through the second connecting passage 109. The first signal terminal 121, the second signal terminal 122 and the third signal terminal 123 are respectively mounted in the fourth terminal groove 104, the fifth terminal groove 105 and the sixth terminal groove 106. All of the resilient portions 121*c*, 122*c*, 123*c* and the resilient arms 141*c*, 142*c* are received in the corresponding indentation areas 108.

Please refer to FIG. 5 and FIG. 6. Before the plug 200 is inserted into the socket 107 of the audio jack connector 100, the first contacting end 141*d* abuts against the second contacting end 142*d*. When the plug 200 is inserted into the socket 107, the plug 200 biases the second contacting end 142*d* to make the second contacting end 142*d* disconnected from the first contacting end 141*d* of the stationary switch terminal 141. Meanwhile, the plug 200 further biases the propping convex 163 of the locking element 16. So the plug 200 can be firmly clipped between the propping convex 163 and the second contacting end 142*d* to ensure a steady electrical connection of the plug 200 and the signal terminal group. Furthermore, the bounce force of the propping convex 163 acts on the plug 200 so that can further make the second contacting end 142*d* keep a disconnected state from the first contacting end 141*d* for the duration of the plug 200 being inserted in the socket 107 of the audio jack connector 100. When the second contacting end 142*d* is excessively biased by the plug 200, the second contacting end 142*d* is received in the opening 141*e* of the stationary switch terminal 141 to avoid the deformation thereof.

As described above, the stationary switch terminal 141 has the opening 141*e* opened in the first fixing slice 141*a* thereof to receive the second contacting end 142*d*, when the plug 200 excessively biases the second contacting end 142*d* of the resilient switch terminal 142. Such structure can avoid the deformation of the second connecting arm 142*b* and further prolong the use life of the audio jack connector 100. Furthermore, the propping convex 163 of the locking element 16 props against the plug 200 so that can keep the second contacting end 142*d* disconnected from the first contacting end 141*d* for the duration of the plug 200 being inserted in the socket 107, and such structure can ensure a stable connection between the plug 200 and the signal terminal group by means of firmly clipping the plug 200 between the propping convex 163 and the second contacting end 142*d*.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector adapted for receiving a plug, comprising:

an insulating housing having a base, the base having a socket extending along the insertion direction of the plug for receiving the plug therein, a first terminal groove and a second terminal groove being opened at one side of the socket, the second terminal groove being located between the socket and the first terminal groove and being connected with the socket by means of a first connecting passage;

a plurality of signal terminals disposed in the insulating housing to electrically connect with the plug;

a stationary switch terminal having a first fixing slice fastened in the second terminal groove, a first connecting arm being bent and then extending from an end edge of the first fixing slice to apart face the first fixing slice, a free end of the first connecting arm being provided with a first contacting end projecting in the first connecting passage, an opening being opened in the first fixing slice and substantially facing to the first contacting end; and a resilient switch terminal having a second fixing slice fastened in the first terminal groove, one end edge of the second fixing slice being bent and then extending to form a second connecting arm received in the first connecting passage, a free end of the second connecting arm being arched towards the socket of the insulating housing to form a second contacting end contacting the first contacting end and projecting into the socket through the first connecting passage, the second contacting end being received in the opening when the second contacting end is biased by the inserted plug to be disconnected from the first contacting end of the stationary switch terminal.

2. The audio jack connector as claimed in claim 1, wherein the first contacting end is formed by the free end of the first connecting arm being obliquely bent oppositely to the first fixing slice.

3. The audio jack connector as claimed in claim 1, wherein strip-shaped first and second resilient arms are respectively extended from top edges of the first and the second fixing slices, and secured on a top surface of the base of the insulating housing.

4. The audio jack connector as claimed in claim 1, wherein the base has a third terminal groove opened at the other side of the socket and connected with the socket by means of a second connecting passage, the audio jack connector further comprises a locking element having a holding slice held in the third terminal groove and a flexible slice connected with an end edge of the holding slice, a free end of the flexible slice is arched towards the second contacting end of the resilient switch terminal to form a propping convex which projects into the socket through the second connecting passage to prop against the plug.

5. The audio jack connector as claimed in claim 1, wherein the second fixing slice is punched away from the second contacting end to form a buckling portion abutting against an inside of the first terminal groove for securing the second fixing slice in the first terminal groove.

* * * * *